United States Patent [19]

Owen et al.

[11] Patent Number: 4,739,129

[45] Date of Patent: Apr. 19, 1988

[54] POWER CABLE WITH REPLACEABLE SWITCH ASSEMBLY

[75] Inventors: William Owen, Canyon Lake; Douglas Chase, Redondo Beach, both of Calif.

[73] Assignee: Wyle Laboratories, El Segundo, Calif.

[21] Appl. No.: 33,408

[22] Filed: Apr. 1, 1987

[51] Int. Cl.[4] ..... H01R 19/52

[52] U.S. Cl. ..... 200/51.04; 200/51.06; 200/281; 200/298; 200/302.1

[58] Field of Search ..... 200/51.06, 51.02, 51.03, 200/51.04, 51.05, 51 R, 51 LM, 298, 281, 302.1

[56] References Cited

U.S. PATENT DOCUMENTS

| | | | |
|---|---|---|---|
| 2,385,165 | 9/1945 | Sears | 200/51.06 |
| 2,480,787 | 8/1949 | Stephan | 200/51 LM |
| 2,492,856 | 12/1949 | Gates | 200/51.06 |
| 4,460,811 | 7/1984 | Murr et al. | 200/51.03 |
| 4,552,143 | 11/1985 | Lottick | 200/281 |
| 4,595,812 | 6/1986 | Tamaru et al. | 200/153 T |

*Primary Examiner*—Renee S. Luebke

*Attorney, Agent, or Firm*—Freilich, Hornbaker, Rosen & Fernandez

[57] ABSTRACT

An electrical box is provided at the outer end of an electrical power cable of the type that supplies power to aircraft parked at an airport, which enables rapid replacement of damaged switches in a compact and watertight arrangement. The electrical box includes a main connector assembly which has a plurality of conductor socket terminals connected to conductors in the cable, and a switch assembly which includes a plurality of switches. The switch assembly fits into a recess in the main housing, and includes projecting pins connected to the switches and which are received in corresponding conductor socket terminals on the main housing. Not only can switches be easily replaced, but the arrangement avoids the need for a bulky connection box where wires of switches are connected to free lengths of the conductors. The switch assembly includes a circular projection from which the pins project, the circular projection including a sealing ring which seals to a corresponding circular recess in the main housing.

6 Claims, 2 Drawing Sheets

FIG. 1
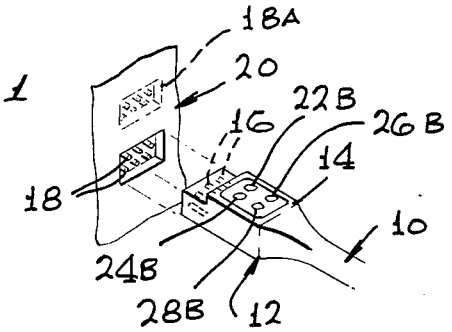
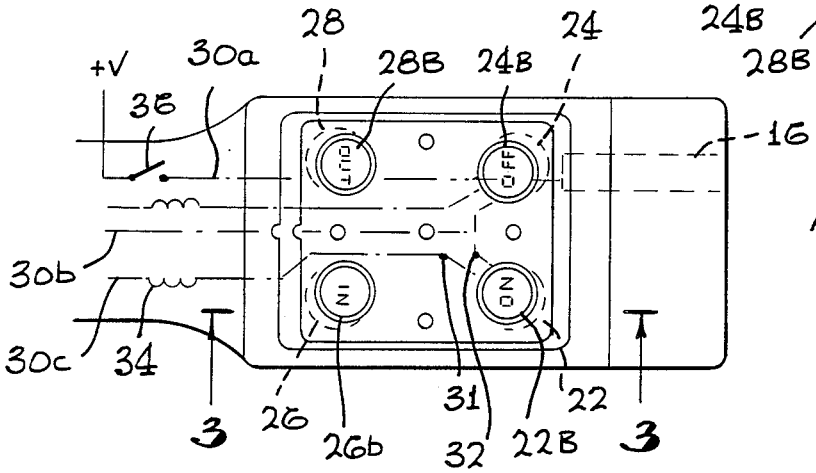
FIG. 2
FIG. 3
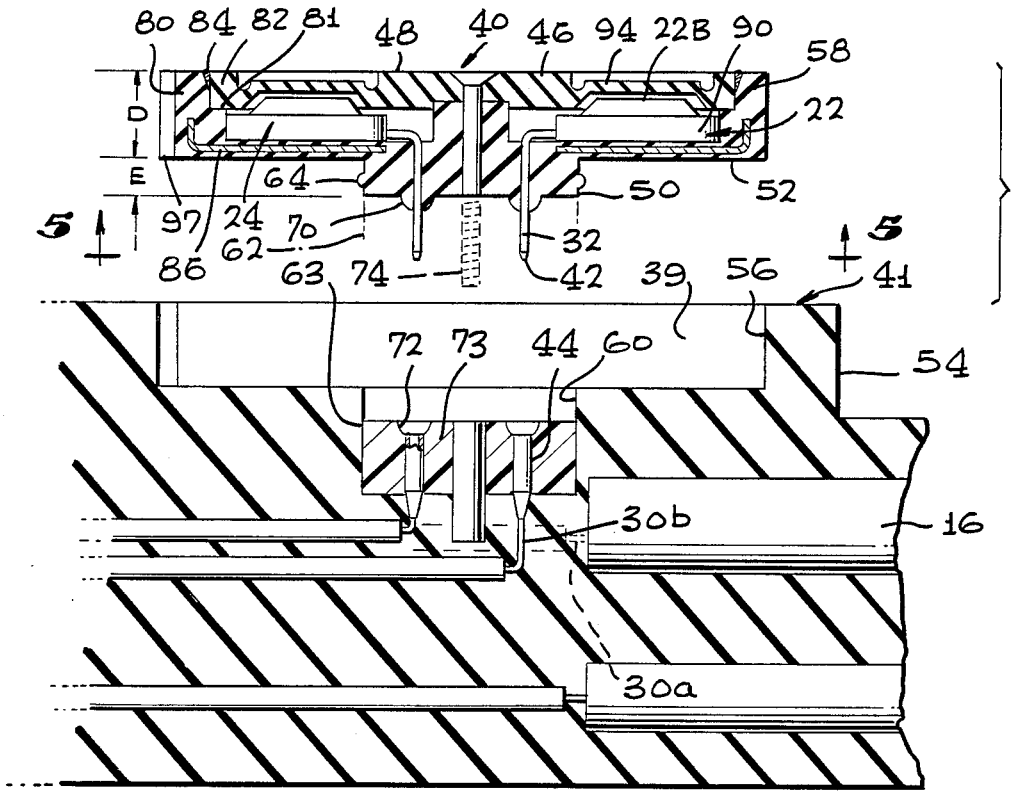

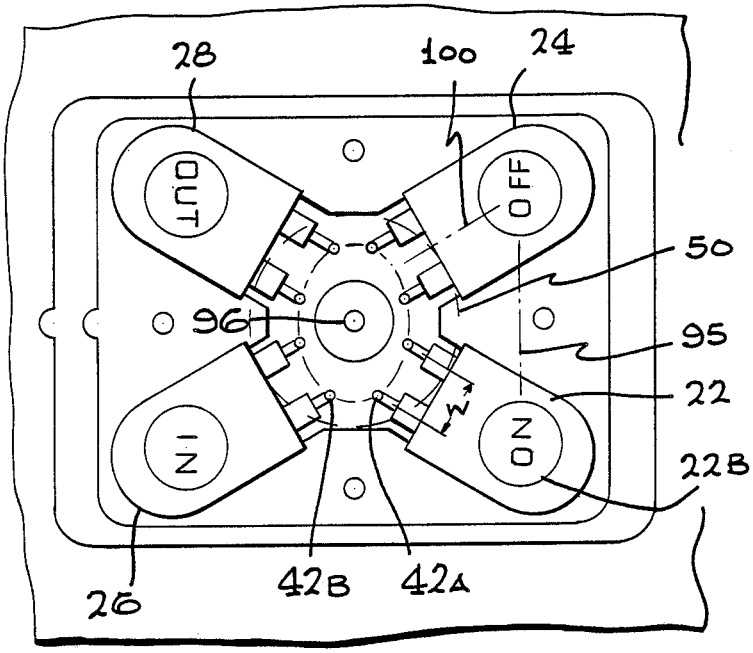
FIG. 4
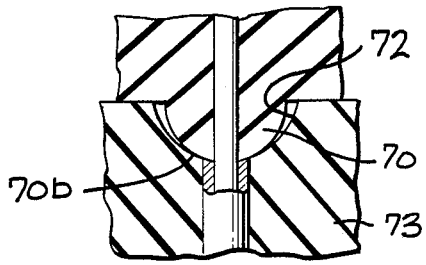
FIG. 5
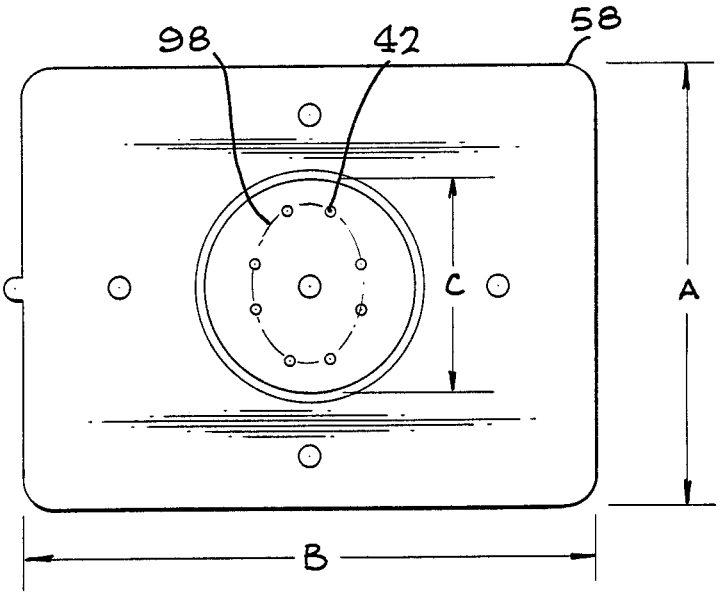

POWER CABLE WITH REPLACEABLE SWITCH ASSEMBLY

BACKGROUND OF THE INVENTION

An airport electrical power supply is coupled to an airliner parked on the ground, through an electrical cable. Prior cables required a workman to turn off power to the cable, pull the cable out to the aircraft and connect it, and then walk back to turn on power. To encourage workmen to not pull out a "hot" cable already connected to the power supply, which could cause sparks and fuel ignition during connection and disconnection, applicant has incorporated switches at the outer end of the cable. This allows workmen to control the application of electrical power from a location at the outer end of the cable.

Applicant has found that the switches at the end of the cable often require replacement. Workmen will sometimes depress a switch by poking it with a screwdriver, or deliberately allow the outer end of the cable to drop several feet onto a concrete runway, all of which can damage the switches. To facilitate switch replacement, a connection box was provided at the end of the cable, which held perhaps one-half foot of length of each cable conductor, to provide for splicing switch wires to them, and where wire-to-wire connections were made. Such connection boxes are bulky. In certain applications such as for connecting to military aircraft where the outer ends of two cables must lie closely adjacent, such connection boxes interfered with such close placement of a pair of electrical cables, and cables without switches at the end had to be used. An electrical cable of the type that connects to aircraft, which enabled switches to be incorporated at the cable end and which enabled replacement of damaged switches in a very compact arrangement which was also watertight, would be of considerable value.

SUMMARY OF THE INVENTION

In accordance with one embodiment of the present invention, an electrical cable assembly is provided, which includes an outer end that has switches and that is compact and easily maintainable. The outer end includes a main housing and conductor terminals on the main housing that are connected to conductors of the cable, and also includes a replaceable switch assembly with switch terminals that mate with the conductor terminals. The switch housing can include a projection of circular cross section which is received in a corresponding recess of circular cross section in the main housing, and the terminals of the switch assembly and main housing lie within extensions of the cross sections of the projection and recess to facilitate watertight sealing thereat.

The novel features of the invention are set forth with particularity in the appended claims. The invention will be best understood from the following description when read in conjunction with the accompanying drawings.

BRIEF DESCRIPTION OF THE DRAWINGS

FIG. 1 is a partial perspective view of the outer end portion of an electrical power cable, showing how it is connected to an aircraft to supply power thereto.

FIG. 2 is a plan view of the outer end of the electrical cable of FIG. 1.

FIG. 3 is a view taken on the line 3—3 of FIG. 2, but with the switch assembly and main connector assembly shown separated.

FIG. 4 is a plan view of the switch assembly of FIG. 3, with the cover thereof removed.

FIG. 5 is a view taken on the line 5—5 of FIG. 3.

FIG. 6 is an enlarged view of a portion of the switch assembly and main connector assembly of FIG. 3, showing the region where the terminals thereof mate.

DESCRIPTION OF THE PREFERRED EMBODIMENTS

FIG. 1 illustrates an electrical power cable 10 which has an outer end 12 forming an electrical box 14 with contacts 16. The contacts 16 can mate with corresponding contacts 18 of an aircraft 20, such as an airliner parked at an airport, to provide electricity to the stationary aircraft. As also shown in FIG. 2, the electrical box includes four switches 22–28 with switch buttons 22B–28B. Switches 22, 24 control the application of electrical power to conductors such as **30*a* that connect to a contact 16, while switches 26, 28 control a motor-driven reel or other mechanism that winds up or pays out the electrical cable. In one example, the switch 22 has a pair of terminals 31, 32 that complete a low-voltage circuit through conductors 30*b*, 30*c* that energizes a coil 34 of a relay to close a switch 36 that applies a high voltage V to the conductor 30. Depression of another switch 24** energizes another coil that opens the relay.

The switches 22–28 are subject to damage, and often require replacement. Workmen will sometimes operate a switch by hitting it with the end of a screwdriver or other tool, which can cause damage. A technician pulling the cable end out on an aircraft may drop the cable on the ground, which can damage the switches. In a prior electrical cable, the electrical box containing the switches included a connection space where connections could be made between switches and cable conductors. That space, similar to that in outlet boxes in homes, provided a space for perhaps six inches at the ends of the conductors, and a few inches at the ends of the switches, where insulation could be removed and the wires spliced. The requirement for such a connection space resulted in considerable time for switch replacement and in a bulky electrical box. In one application, for military aircraft, where two contact groups 18, 18A (FIG. 1) were closely adjacent on the aircraft, electrical cables without switches at the ends had to be used so that they did not interfere with each other.

As shown in FIG. 3, applicant uses a separate switch assembly 40 which can be plugged into and removed from a switch assembly receiving region 39 of a main connector assembly 41 of the electrical box. The switches 22–28 of the switch assembly have switched terminals such as 32 which include projecting pins 42. The main assembly 42 includes corresponding conductor terminals 44, of which some are directly connected to cable conductors such as 30. The conductor terminals 44 are in the form of sockets that receive the pins 42 of the switch assembly. The main housing 54 at the main connector assembly is permanently sealed around the conductor terminals.

The switch assembly 40 includes a switch housing 46 which has a largely rectangular upper portion 58 with a rectangular upper face 48 to match the largely rectangular electrical box. The switch housing also includes a projection 50 of largely circular cross section extending from a lower face 52 of the rectangular portion of the switch assembly. The main assembly 41 includes a housing 54 with a substantially rectangular recess 56 which receives the rectangular portion 58 of the switch assembly, and also has a lower recess, or projection receiving recess, 60 of substantially circular cross section which receives the lower projection 50 of the switch assembly.

The switches are arranged so that their terminals all lie within an imaginary extension 62 of the projection 50. The conductor terminals 44 similarly lie within an extension 63 of the lower recess 60 in the main housing. This allows watertight sealing around the mating terminals 42, 44 to occur in a region of circular cross section, which is easier to seal than rectangular shapes, and in a region of relatively small cross section where there is a minimum periphery to be sealed. A ring-like seal 64 is formed on the switch housing projection 50, which lies in interference fit with the lower recess 60 in the main housing, to form the watertight seal. The rectangular upper portion 58 of the switch assembly is intended to make a substantially watertight seal with the walls of the upper recess 56 by slight interference fit, although such sealing is not as reliable as at the circular projection 50.

Further sealing is provided around each of the pin contacts 42 by providing a semi-spherical protuberance 70 around each pin terminal of the switch assembly, and by providing a corresponding tapered recess 72 around the outside of each socket conductor terminal 44. As shown in FIG. 6, the recess 72 is wider than the protuberance 70. The protuberance 70 is formed of an elastomeric material such as moderately soft rubber, while the walls of the recess 72 are of a harder material 73 such as of a relatively rigid plastic. As the switch assembly is pushed into place, the bottom **70*b* of the protuberance is deformed into relatively wide area contact with the walls of the recess 72 to provide a good seal. The switch assembly is installed by first pressing it into the recesses of the main housing, and then installing screws 74 to hold the switch assembly in place. Radial sealing occurs around the ring seal 64 as it enters the corresponding recess 60, while axial sealing occurs around each of the pin contacts as the screws are tightened and the protuberance 70** around each pin contact are deformed.

The switch assembly housing 46 (FIG. 3) includes a base 80 with an inner recess 81 and a cover 82 that fits closely into the inner recess and which is sealed at 84 to the base. Both parts are made of moderately resilient rubber. A steel mounting plate 86 is molded into the base to provide general rigidity of shape. The switches such as 22 each have a body 90, a push button such as 22B that operates the switch, and terminals 32 that extend from the switch and form the pin terminals 42. The cover is formed with membrane regions 94 that form part of the push buttons and which can be depressed to operate the switches. The switches are arranged as shown in FIG. 4, with their centers on an imaginary nonsquare rectangle 95. It might be desirable to evenly space the terminal pins 42 of the switches around the axis 96 of the switch assembly, but the switch terminals have a predetermined relatively wide spacing W and it is desirable that the projection 50 and its extension 63 have a small diameter. Applicant arranges the switch terminal pins 42 on an imaginary non-circular elipse 98 (FIG. 5) which has a length about 35% greater than its width. The center lines 100 (FIG. 4) of the switches are spaced from the switch assembly axis 96. This arrangement results in the terminals such as 42A, 42B of adjacent switches being uniformly widely spaced even though the centers of the switch buttons do not lie on a square. The length of the elipse 98 is perpendicular to the length of the rectangle 95.

When a switch is damaged, the entire switch assembly is replaced by pulling out the old one and plugging in the new one, with a key 97 on the switch assembly assuming proper orientation. The switch assembly has a small thickness, and the main housing has a relatively small thickness because of the absence of the need for a wire connecting region. The switch assembly can be rapidly and reliably installed, while automatically providing reliable sealing.

In an electrical box applicant has constructed, the rectangular upper portion 58 of the switch assembly had a width A and length B of 73 mm and 98 mm, respectively. The circular lower protrusion 50 had a diameter C of 35 mm, which is no more than about one-half the width of the upper rectangular switch housing portion. The upper portion 58 had a thicknes D (FIG. 3) of 13 mm, and the projection 50 had a length E of 7 mm, for a total switch assembly housing thickness of 19 mm.

Thus, the invention provides an electrical box for the end of an electrical power cable, which enables the inclusion of switches while maintaining a low profile and facilitating maintenance. The switches are part of a replaceable switch assembly wherein the switches are sealed except for switch terminals such as pins that project from the switch assembly housing. A main housing receives the switch assembly, with the pins of the switch assembly terminals received in corresponding sockets connected to conductors of the cable. The switch terminals lie within the boundries of a substantially circular switch housing projection that is closely received in a corresponding circular recess of the main housing to provide a waterproof seal. An additional axial pressure seal is provided by protuberances around the ends of the pins.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. In an electrical cable assembly which includes an electrical power cable having a plurality of electrical conductors and having an outer end which has conductor contacts that can be connected to contacts on an aircraft to supply power thereto, an improvement comprising:

a main connector assembly at the outer end of said cable, including a main housing and a plurality of conductor socket terminals each connected to one of said conductors, said main housing having an upper face forming a largely rectangular recess having a bottom and including walls forming a circular recess of substantially circular cross section at the bottom of said rectangular recess, said circular recess having a bottom and said socket terminals having pin-receiving holes at the bottom of said circular recess;

a switch assembly which includes a switch housing, said switch housing includes a base having a periphery that is closely received in said rectangular recess of said main housing, and which has a largely rectangular inner recess, said base having a lower projection of substantially circular cross section which fits closely into said circular recess of said main housing, said projection including a radially outwardly projecting ring at its periphery which seals to the walls of said circular recess;

said switch assembly including a plurality of switches mounted on said base with each switch having an upper face and a push button thereat and having a pair of switch terminals ending in downwardly-projecting pins, said pins projecting through and below said lower projection and received in said socket terminals;

said switch assembly also including a cover of resilient material which closely fits into said inner recess, said cover forming depressible membrane portions over said switch buttons.

2. In an electrical power cable having a plurality of electrical conductors and having an outer end which has conductor contacts that can be connected to contacts on an aircraft to supply power thereto, an improvement comprising:

a main connector assembly including a main housing located at the outer end of said cable and a plurality of conductor terminals, each conductor terminal connected to a different one of a plurality of said conductors, said main housing being permanently sealed around the conductors connected to said conductor terminals, said housing including a switch assembly receiving region and said conductor terminals accessible from said region;

a switch assembly which includes a switch housing having a noncircular periphery of a width A and a circular projection of a width C that is smaller than A, said switch housing having a face and a plurality of switches operable from said face, each switch having a pair of switch terminals and said switches being sealed in said switch housing except for said switch terminals, said switch terminals lying within the periphery of said projection and being accessible from outside said switch housing from the end of said projection, said switch assembly being detachably receivable in said receiving region of said main housing with said switch terminals detachable mateable with said conductor terminals;

said switch assembly receiving region of said main housing including a first recess which closely receives said switch housing, and a circular projection-receiving recess lying within said first recess for closely receiving said circular projection, said conductor terminals lying within the periphery of said projection-receiving recess and positioned to mate with said switch terminals.

3. In an electrical power cable having a plurality of electrical conductors and having an outer end which has conductor contacts that can be connected to contacts on an aircraft to supply power thereto, an improvement comprising:

a main connector assembly including a main housing located at the outer end of said cable and a plurality of conductor terminals, each conductor terminal connected to a different one of a plurality of said conductors, said main housing being permanently sealed around the conductors connected to said conductor terminals, said housing including a switch assembly receiving region and said conductor terminals accessible from said region;

a switch assembly which includes a switch housing having a face and a plurality of switches operable from said face, each switch having a pair of switch terminals and said switches being sealed in said switch housing except for said switch terminals, said switch terminals being accessible from outside said switch housing, said switch assembly being detachably receivable in said receiving region of said main housing with said switch terminal detachably mateable with said conductor terminals;

said switch housing having a largely rectangular periphery, with a length and a width smaller than the length, and said plurality of switches including four substantially identical switches, each having a push button and a pair of parallel leads of predetermined length and spaced a predetermined distance W apart, the centers of each push buttons located at the corners of an imaginary second rectangle having a width smaller than its length;

the ends of said switch terminals being located on a noncircular ellipse.

4. The improvement described in claim 3 wherein:

the length of said second rectangle is perpendicular to the length of said ellipse.

5. In an electrical power cable having a plurality of electrical conductors and having an outer end which has conductor contacts that can be connected to contacts on an aircraft to supply power thereto, an improvement comprising:

a main connector assembly including a main housing located at the outer end of said cable and a plurality of conductor terminals, each conductor terminal connected to a different one of a plurality of said conductors, said main housing being permanently sealed around the conductors connected to said conductor terminals, said housing including a switch assembly receiving region and said conductor terminals accessible from said region;

a switch assembly which includes a switch housing having a face and a plurality of switches operable from said face, each switch having a pair of switch terminals and said switches being sealed in said switch housing except for said switch terminals, said switch terminals being accessible from outside said switch housing, said switch assembly being detachably receivable in said receiving region of said main housing with said switch terminals detachably mateable with said conductor terminals;

said switch terminals forming pins projecting from said switch housing and having inner ends and free outer ends, and said switch housing including resilient protrusions lying about the pin inner ends;

said main housing including recesses about said conductor terminals for receiving and pressing against said protrusions to seal thereagainst.

6. In an electrical power cable having a plurality of electrical conductors and having an outer end which has conductor contacts that can be connected to contacts on an aircraft to supply power thereto, an improvement comprising:

a main connector assembly at the outer end of said cable, including a main housing and a plurality of conductor terminals each connected to one of said conductors, said main housing including walls forming a recess of substantially circular cross section and said conductor terminals located within said recess;

a switch housing including a lower projection of substantially circular cross sesction which includes a ring seal that seals to the walls of said recess, said switch terminals projecting downwardly from said projection, to mate with said conductor terminals as the projection approaches and enters said recess;

said switch terminals forming pins and said switch housing including elastomeric protuberances of substantially hemispherical shape around each of said pins, each of said protuberances having a center and said main housing formed to deform the centers of said protuberances as the switch assembly is pressed against said main assembly, and including fastener means for pressing and holding said switch and main housings together.

* * * * *